US007225522B1

(12) United States Patent
Little

(10) Patent No.: US 7,225,522 B1
(45) Date of Patent: Jun. 5, 2007

(54) METHOD FOR PRODUCING RACK AND PINION GEAR YOKE ASSEMBLY

(75) Inventor: Scott C. Little, Rogersville, TN (US)

(73) Assignee: TRW Automotive U.S. LLC, Livonia, MI (US)

( * ) Notice: Subject to any disclaimer, the term of this patent is extended or adjusted under 35 U.S.C. 154(b) by 629 days.

(21) Appl. No.: 10/738,673

(22) Filed: Dec. 17, 2003

(51) Int. Cl.
*B21D 39/00* (2006.01)
*B21D 47/00* (2006.01)

(52) U.S. Cl. ..... 29/505; 29/897.2

(58) Field of Classification Search ..... 29/505, 29/506, 508, 520, 428, 897.2; 74/422, 498; 180/428, 423, 441, 422
See application file for complete search history.

(56) References Cited

U.S. PATENT DOCUMENTS 5,906,138 A 5/1999 Kostrzewa
6,467,366 B1 10/2002 Gierc
6,539,821 B2 * 4/2003 Bugosh ..... 74/422
6,591,706 B2 7/2003 Harer et al.
6,619,420 B1 9/2003 Saarinen

* cited by examiner

*Primary Examiner*—John C. Hong
(74) *Attorney, Agent, or Firm*—MacMillan, Sobanski & Todd, LLC

(57) ABSTRACT

A method for producing a yoke assembly (306, 406, 506, 606) adapted for use in a rack and pinion steering gear assembly (10) for a vehicle includes providing a yoke housing (302, 402, 502, 602), and a yoke cap (310) having a side-wall (328). The yoke housing (302, 402, 502, 602) includes a wall (302A) defining a yoke chamber (304) and an opened end (312). The wall (302A) is provided with a recess (314) formed therein. The yoke cap (310) is disposed about the opened end (312) of the yoke housing (302, 402, 502, 602) such that the yoke cap (310) extends adjacent at least a portion of the recess (314). The side-wall (328) of the yoke cap (310) is subjected to a metal deforming operation to cause a portion of the side-wall (328) of the yoke cap (310) to be deformed and reshaped to substantially conform to the shape of the recess (314), thereby attaching the yoke cap (310) on the yoke housing (302, 402, 502, 602).

8 Claims, 9 Drawing Sheets

METHOD FOR PRODUCING RACK AND PINION GEAR YOKE ASSEMBLY

BACKGROUND OF THE INVENTION

This invention relates in general to rack and pinion steering gears and in particular to an improved yoke assembly for use with such a rack and pinion steering gear.

A known rack and pinion steering gear includes a pinion gear that is rotatably mounted in a housing and is connectable with a steering wheel of a vehicle. A rack bar extends through the housing and has opposite end portions that are connectable with steerable vehicle wheels. The rack bar moves longitudinally relative to the housing for turning the steerable wheels of the vehicle. Gear teeth formed on the rack bar are disposed in meshing engagement with gear teeth on the pinion gear. A yoke assembly is disposed in the housing to support and guide movement of the rack bar relative to the housing. The yoke assembly includes a yoke bearing having an arcuate surface across which the rack bar moves. A spring biases the yoke bearing against the rack bar.

The yoke bearing is typically held within a bore of the housing by a threaded cap. Such a threaded cap adds cost to the yoke assembly and reduces the space available in the housing available for the yoke bearing. Thus, it would be desirable to provide an improved structure for a yoke assembly adapted for use in a rack and pinion steering gear which is simple and inexpensive.

SUMMARY OF THE INVENTION

The present invention relates to a method for producing a yoke assembly adapted for use in a rack and pinion steering gear assembly for a vehicle. The method includes providing a yoke housing, and a yoke cap having a side-wall. The yoke housing includes a wall defining a yoke chamber and an opened end. The wall is provided with a recess formed therein. The yoke cap is disposed about the opened end of the yoke housing such that the yoke cap extends adjacent at least a portion of the recess. The side-wall of the yoke cap is subjected to a metal deforming operation to cause a portion of the side-wall of the yoke cap to be deformed and reshaped to substantially conform to the shape of the recess, thereby attaching the yoke cap on the yoke housing.

The present invention also relates to a yoke assembly adapted for use in a rack and pinion steering gear assembly for a vehicle. The yoke assembly includes a yoke housing having a wall. The wall defines a yoke chamber and an opened end, and the wall is provided with a recess having a predetermined shape formed in an outer surface thereof. A yoke cap is attached to the yoke housing. The yoke cap has a side-wall disposed adjacent an outer portion of the wall of the yoke housing. At least a portion of the side-wall of the yoke substantially conforms to the predetermined shape of the recess in the wall of the yoke housing to thereby attach the yoke cap to the yoke housing.

Other advantages of this invention will become apparent to those skilled in the art from the following detailed description of the invention, when read in light of the accompanying drawings.

DETAILED DESCRIPTION OF THE INVENTION

Figure 1:
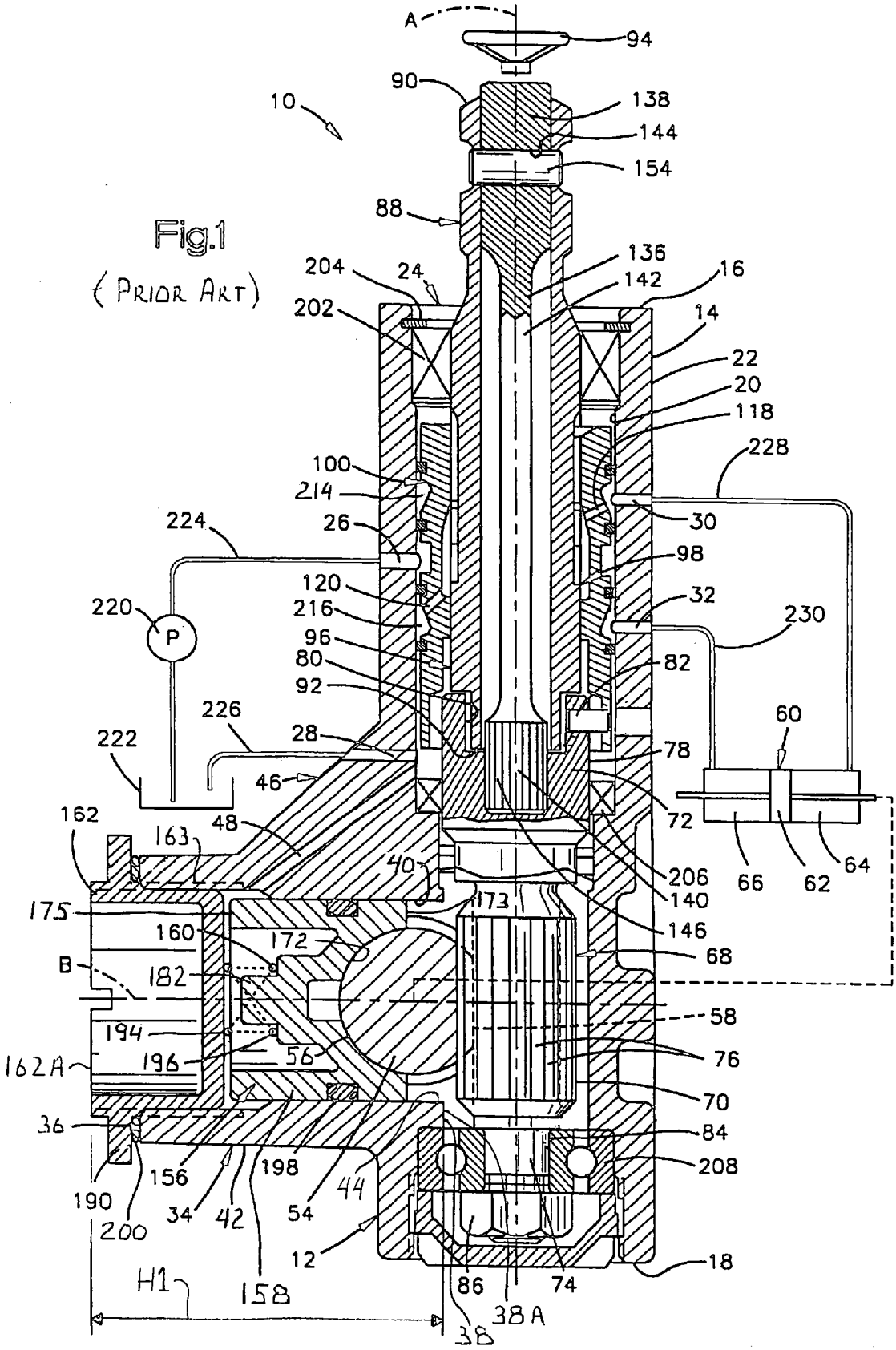
Fig.1 (PRIOR ART)
FIG. 1 is a sectional view of a prior art rack and pinion steering gear.

Referring to FIG. 1, there is illustrated a prior art rack and pinion steering gear, indicated generally at 10. The general structure and operation of the rack and pinion steering gear 10 is conventional in the art. Thus, only those portions of the steering gear 10 which are necessary for a full understanding of this invention will be explained and illustrated in detail. Also, although this invention will be described and illustrated in connection with the particular rack and pinion steering gear 10 disclosed herein, it will be appreciated that this invention may be used in connection with other types of rack and pinion steering gears. For example, the portions of the rack and pinion steering gear which define the present invention can be used with any of the rack and pinion steering gears shown in U.S. Pat. No. 6,619,420 to Saarinen, U.S. Pat. No. 6,591,706 to Harer et al., and U.S. Pat. No. 6,467,366 to Gierc, the disclosures of each of these patents incorporated herein by reference.

The rack and pinion steering gear 10 includes a housing 12. The housing 12 has a first tubular portion 14 that extends along an axis A. The first tubular portion 14 has first and second axial ends 16 and 18, respectively, and cylindrical inner and outer surfaces 20 and 22, respectively. The inner surface 20 of the first tubular portion 14 of the housing 12 defines a pinion chamber or passage 24 that extends through the first tubular portion 14. Four radially extending openings extend from the inner surface 20 to the outer surface 22 of the first tubular portion 14. The openings include a fluid inlet opening 26, a fluid outlet opening 28, and first and second motor openings 30 and 32, respectively.

The housing 12 also includes a second tubular portion or yoke housing 34. The yoke housing 34 extends perpendicular to the first tubular portion 14 along an axis B. As shown in prior art FIG. 1, the yoke housing 34 has first and second ends 36 and 38, respectively, an inner surface 40 and an outer surface 42. The second end 38 of the yoke housing 34 unites with the first tubular portion 14 near the second axial end 18 of the first tubular portion 14. The inner surface 40 of the yoke housing 34 defines a yoke chamber or yoke bore 44. The yoke bore 44 mates with the passage 24 of the first tubular portion 14 near the second axial end 18 of the first tubular portion 14. The yoke bore 44 is preferably provided with a threaded portion adjacent the first end 36.

A thickened wall portion 46 of the housing 12 is formed where the first tubular portion 14 mates with the yoke housing 34. The thickened wall portion 46 is located between the fluid outlet opening 28 of the first tubular portion 14 and the yoke housing 34 of the housing 12. A fluid passage 48 extends through the thickened wall portion 46 and connects the passage 24 of the first tubular portion 14 to the yoke bore 44 of the yoke housing 34. Preferably, the fluid passage 48 is cast into the thickened wall portion 46 of the housing 12. The fluid passage 48 fluidly connects the passage 24 and the yoke bore 44.

A longitudinally extending rack bar 54 extends through the housing 12 in a direction that is perpendicular to both axis A and axis B. The rack bar 54 has a generally circular cross-sectional shape that is defined by a generally cylindrical outer surface 56. An upper surface 58 of the rack bar 54 includes a plurality of teeth (not shown). Opposite end portions (not shown) of the rack bar 54 are connectable with steerable wheels (not shown) of a vehicle (not shown). Movement of the rack bar 54 in a longitudinal direction relative to the housing 12 results in the turning of the steerable wheels of the vehicle.

A hydraulic motor 60, shown schematically in prior art FIG. 1, is also formed in the housing 12. The hydraulic motor 60 includes a piston 62, which is attached to the rack bar 54. The piston 62 separates two variable volume chambers 64 and 66, respectively. One chamber 64 or 66 is located on each side of the piston 62. The hydraulic motor 60 is actuated when a differential pressure arises between the two chambers 64 and 66. The hydraulic motor 60 discontinues operation when the pressure between the two chambers 64 and 66 equalizes. When the hydraulic motor 60 is actuated, fluid pressure moves the piston 62. Movement of the piston 62 results in movement of the rack bar 54 in the longitudinal direction relative to the housing 12.

As shown in prior art FIG. 1, a pinion gear 68 includes a gear portion 70, a first support portion 72, and a second support portion 74. The gear portion 70 has a plurality of teeth 76 for meshingly engaging the teeth of the rack bar 54. The first support portion 72 of the pinion gear 68 forms a first axial end of the pinion gear 68. The first support portion 72 includes a cylindrical outer surface 78. An axially extending cavity 80 extends into the first support portion 72. A hole, shown generally at 82, extends radially through the first support portion 72 and terminates at the cavity 80.

The second support portion 74 of the pinion gear 68 forms a second axial end of the pinion gear 68. The second support portion 74 has a cylindrical outer surface 84. The diameter of the second support portion 74 of the pinion gear 68 is less than the diameter of the first support portion 72. An end of the cylindrical outer surface 84 of the second support portion 74, opposite the gear portion 70, is threaded for receiving a pinion nut 86.

An input shaft 88 includes first and second axial ends 90 and 92, respectively. The first axial end 90 of the input shaft 88 is connectable with a steering wheel 94 of the vehicle. The second axial end 92 of the input shaft 88 includes a valve core part 96.

The prior art rack and pinion steering gear 10 also includes a valve assembly, shown generally at 98. The valve assembly 98 includes a valve sleeve part 100 and the valve core part 96. The valve sleeve part 100 of the valve assembly 98 of the rack and pinion steering gear 10 is tubular.

A first set of passages 118 extends radially outwardly through the valve sleeve part 100. The first set of passages includes three passages 118, only one of which is shown in prior art FIG. 1. A second set of passages 120 extends radially outwardly through the valve sleeve part 100. The second set of passages 120 includes three passages 120, only one of which is shown in prior art FIG. 1.

A torsion bar 136 includes first and second axial end portions 138 and 140, respectively, and an intermediate portion 142. The first axial end portion 138 is cylindrical. A radially extending hole 144 extends through the first axial end portion 138. The second axial end portion 140 is also generally cylindrical and includes a splined outer surface 146. The first axial end portion 138 of the torsion bar 136 is then fixed to the input shaft 88 using a pin 154.

The prior art rack and pinion steering gear 10 also includes a yoke assembly 156. As shown in prior art FIG. 1, the yoke assembly 156 includes a yoke bearing 158, a spring 160, and a yoke plug 162. The yoke housing 34 and the yoke plug 162 define an axial height H1. The axial height H1 is defined as the distance between an outer end surface 38A of the second end 38 of the yoke housing 34 and an outer end surface 162A of the yoke plug 162.

The yoke bearing 158 is generally cylindrical in shape and includes a cylindrical outer side-wall 164. A recess 172 extends into a first end surface 173 of the yoke bearing 158. The recess 172 is defined by an arcuate shaped recess surface. Preferably, the arc of the arcuate shaped recess surface is partially cylindrical with a radius that is equal to a radius of the outer surface 56 of the rack bar 54. A cylindrical spring guide 182 extends outwardly from a second end surface 175 of the yoke bearing 158. The spring guide 182 is centered on the axis B.

The spring 160 of the yoke assembly 156 illustrated in prior art FIG. 1 is a helical compression spring. The spring 160 has a first axial end 194 and an opposite second axial end 196. The spring 160 also has a known spring constant. The yoke plug 162 is preferably cup-shaped and includes a threaded outer surface 163, and an outwardly extending annular flange 190.

The yoke assembly 156 also includes two fluid-tight seals 198 and 200. The seals 198 and 200 are preferably O-rings. The first seal 198 is designed to seal between the cylindrical outer side wall 164 of the yoke bearing 158 and the yoke bore 44 of the yoke housing 34 of the housing 12. The second seal 200 is designed to seal between the flange 190 of the yoke plug 162 and the first end 36 of the yoke housing 34 of the housing 12. The first seal 198 also reduces noise, vibration, and harshness (NVH) between the yoke bearing 158 and the yoke bore 44.

As shown in prior art FIG. 1, the rack and pinion steering gear 10 includes three bearing assemblies. A first bearing assembly 202 is located adjacent the opening at the first axial end 16 of the first tubular portion 14 of the housing 12. The first bearing assembly 202 extends between the housing 12 and the input shaft 88 and enables rotation of the input shaft 88 relative to the housing 12. A retaining ring 204 holds the first bearing assembly 202 in the first tubular portion 14 of the housing 12.

A second bearing assembly 206 is located in the passage 24 of the first tubular portion 14 between the fluid outlet opening 28 and the yoke bore 44. The second bearing assembly 206 extends between the housing 12 and the first support portion 72 of the pinion gear 68 and enables rotation of the pinion gear 68 relative to the housing 12.

A third bearing assembly 208 is located in the passage 24 of the first tubular portion 14 between the yoke bore 44 and the second axial end 18 of the first tubular portion 14. The third bearing assembly 208 extends between the housing 12 and the second support portion 74 of the pinion gear 68 and enables rotation of the pinion gear 68 relative to the housing 12. The third bearing assembly 208 is held in the housing 12 and relative to the pinion gear 68 by the pinion nut 86 that is screwed onto the threads of the second support portion 74.

As shown in prior art FIG. 1, a pump 220 draws hydraulic fluid from a reservoir 222 and supplies the hydraulic fluid to the rack and pinion steering gear 10. A conduit 224 extends between pump 220 and the fluid inlet opening 26 of the housing 12 for carrying fluid from the pump 220 to the rack and pinion steering gear 10. A conduit 226 extends from the fluid outlet opening 28 of housing 12 to the reservoir 222 for returning hydraulic fluid to the reservoir 222. The rack and pinion steering gear 10 also includes a conduit 228 that extends from the first motor opening 30 to the chamber 64 of the hydraulic motor 60 and a conduit 230 that extends from the second motor opening 32 to the chamber 66. As shown in prior art FIG. 1, conduit 228 provides fluid communication between a first annular motor channel 214 and the chamber 64 of the hydraulic motor 60. Conduit 230 provides fluid communication between a second annular motor channel 216 and the chamber 66 of the hydraulic motor 60. Fluid flow through the conduits 228 and 230 is bi-directional. Thus, when the volume of chamber 64 of the hydraulic motor 60 is increasing, fluid flows through the conduit 228 toward the hydraulic motor and through conduit 230 away from the hydraulic motor 60. When the volume of chamber 64 of the hydraulic motor 60 is decreasing, fluid flows through conduit 230 toward the hydraulic motor 60 and through conduit 228 away from the hydraulic motor 60.

When the prior art rack and pinion steering gear 10 is mounted in a vehicle, the input shaft 88 is operatively coupled to the steering wheel 94 of the vehicle. Rotation of the steering wheel 94 results in rotation of the input shaft 88. Since the input shaft 88 is fixed relative to the first axial end portion 138 of the torsion bar 136, rotation of the input shaft 88 results in rotation of the first axial end portion 138 of the torsion bar. If resistance to the turning of the steerable wheels of the vehicle is above a threshold level, the second axial end portion 140 of the torsion bar 136 will not be rotated by rotation of the first axial end portion 138 of the torsion bar. As a result, rotation of the first axial end portion 138 of the torsion bar 136 relative to the second axial end portion 140 will cause torsion or twisting of the intermediate portion 142 of the torsion bar. Torsion of the intermediate portion 142 of the torsion bar 136 causes the valve core part 96 to move relative to the valve sleeve part 100. The construction of the prior art rack and pinion steering gear 10 thus far described is conventional in the art.

Figure 2:
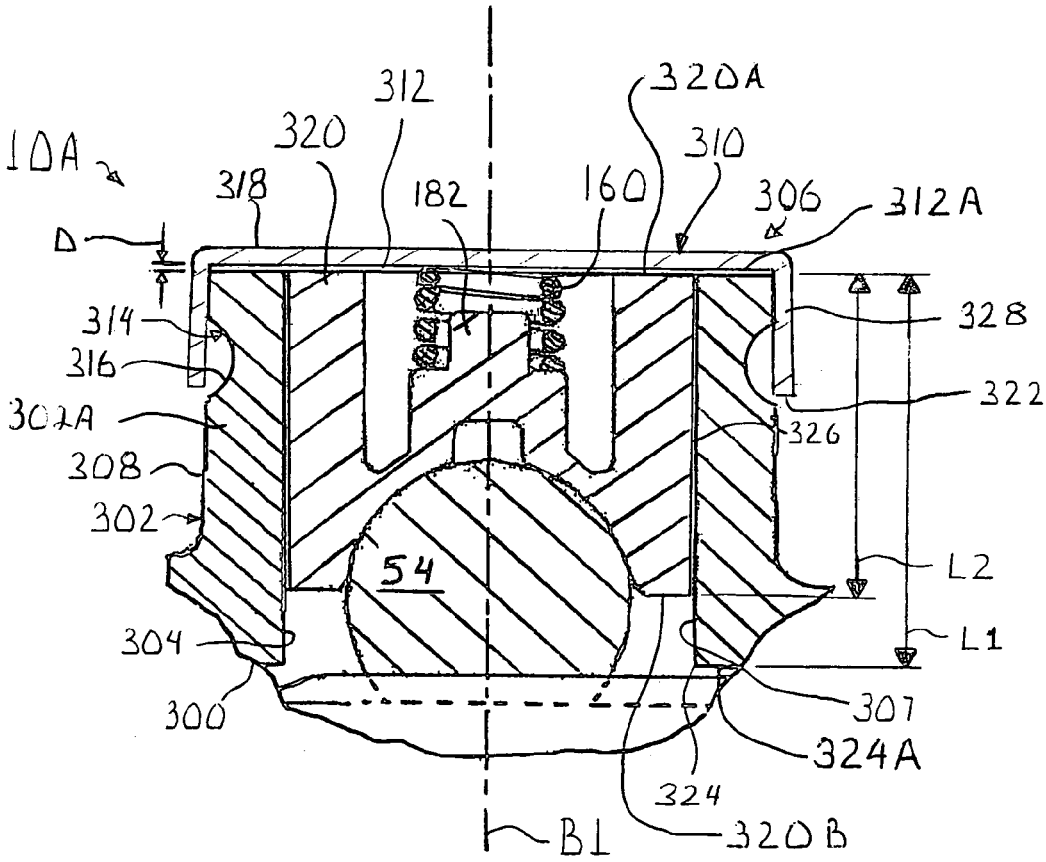
FIG. 2 is an enlarged sectional view of a portion of a rack and pinion steering gear including a first embodiment of a yoke assembly constructed in accordance with the present invention and shown in an unassembled position.

Referring now to FIG. 2 and using like reference numbers to indicate corresponding parts, there is illustrated a portion of a steering gear, indicated generally at 10A, including a first embodiment of a yoke assembly 306 according to the present invention. The steering gear 10A includes a gear housing 300 having a yoke portion or housing 302. The yoke housing 302 defines an axis B1 and includes a yoke chamber or bore 304. Preferably, the housing 300 is cast from a suitable materials, such as for example, steel or aluminum. As illustrated in this embodiment, the yoke assembly 306 is shown disposed in the yoke housing 302 and includes a yoke bearing 320, a spring 160, and a yoke cap 310. However, it will be understood that the yoke housing 302 and the yoke cap 310 can be used with any desired steering gear, for example, with the steering gear 10 shown in prior art FIG. 1.

The yoke housing 302 is substantially cylindrical in shape and includes a wall 302A defining an inner surface 307, an outer surface 308, and an opened end 312. The inner surface 307 of the yoke housing 302 defines the yoke bore 304. The yoke bore 304 defines a first axial length L1. The first axial height L1 is defined as the distance between an outer end surface 324A of a lower end 324 of the yoke housing 302 and an outer end surface 312A of the opened end 312. A recess 314 is formed in the outer surface 308 of the yoke housing 302. In the exemplary first embodiment illustrated in FIGS. 2 and 3, the recess 314 is a circumferential groove. Preferably, the groove 314 has a substantially arcuate surface 316. Alternatively, the shape of the recess 314 can be other than illustrated if so desired. Such alternative recess shapes are described below.

Figure 3:
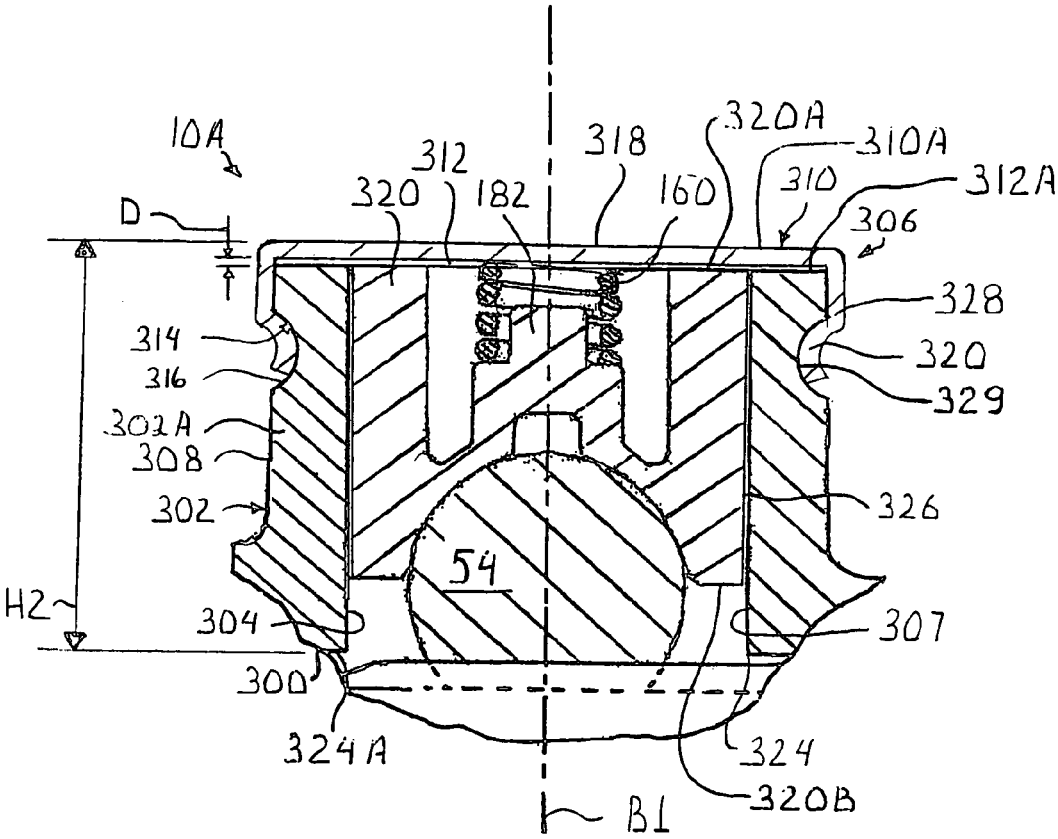
FIG. 3 is an enlarged sectional view of the portion of the rack and pinion steering gear illustrated in FIG. 2 showing the first embodiment of the yoke assembly in an assembled position.

The yoke cap 310 is substantially cup-shaped and has a closed end 318, a generally cylindrical side-wall 328, and an opened end 322. The yoke cap 310 is shown in a first or unassembled position in FIG. 2, and in a second or assembled position in FIG. 3. When in the assembled position as shown in FIG. 3, the yoke housing 302 and the yoke cap 310 define a yoke height H2. The yoke height H2 is defined as the distance between the outer end surface 324A of the lower end 324 (as viewed in the Figures) of the yoke bore 304 and an outer surface 310A of the yoke cap 310. The yoke cap 310 can be made by any suitable process from any suitable electrically conductive material, for reasons which are explained herein. For example, the yoke cap 310 can be stamped or machined, and made from any suitable grade of steel or aluminum. Alternately, the yoke cap 310 can be formed from other materials, such as for example, other electrically conductive metals and electrically conductive non-metals.

Figure 10:
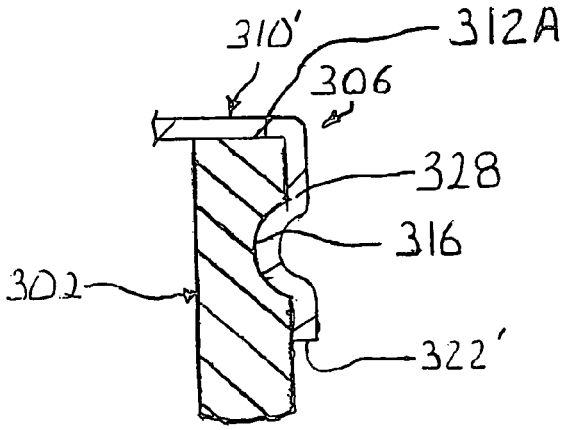
FIG. 10 is an enlarged sectional view of a portion of the yoke housing illustrated in FIG. 3 showing an alternate embodiment of the yoke cap in an assembled position.

In the exemplary embodiment illustrated in FIGS. 2 and 3, the yoke cap 310 is shown spaced from the outer end surface 312A by a distance D. The distance D defines a cap clearance or gap. Alternately, the yoke cap 310 can be disposed about the opened end 312 such that the yoke cap 310 engages the outer end surface 312A (i.e. there is no clearance between the yoke cap 310 and the opened end surface 312A) as shown in FIG. 10.

The yoke assembly 306 further includes the yoke bearing 320. The yoke bearing 320 is substantially identical to the yoke bearing 158 except that the yoke bearing 320 does not include a recess for the seal 198 for reasons that will be explained herein. The yoke bearing 320 is generally cylindrical in shape and includes a cylindrical outer side wall 326 which defines a second axial length L2. The second axial length L2 is defined as the distance between a first outer end surface 320A and a second outer end surface 320B of the yoke bearing 320. As previously described regarding prior art FIG. 1, the spring 160 is disposed about the cylindrical spring guide 182 and normally biases the yoke bearing 320 away from the yoke cap 310 and against the rack bar 54.

Figure 4:
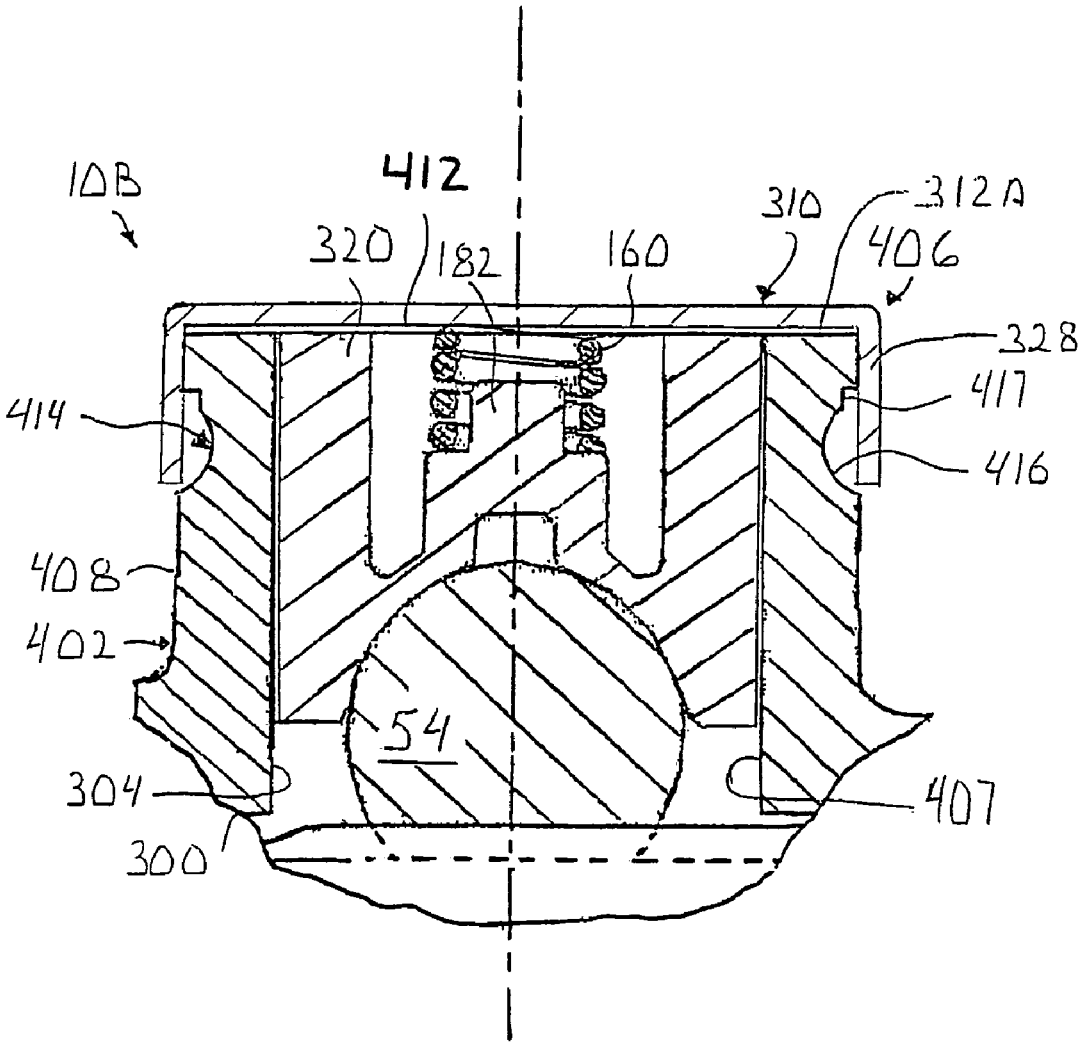
FIG. 4 is an enlarged sectional view of a portion of a rack and pinion steering gear including a second embodiment of a yoke assembly constructed in accordance with the present invention and shown in an unassembled position.
Figure 5:
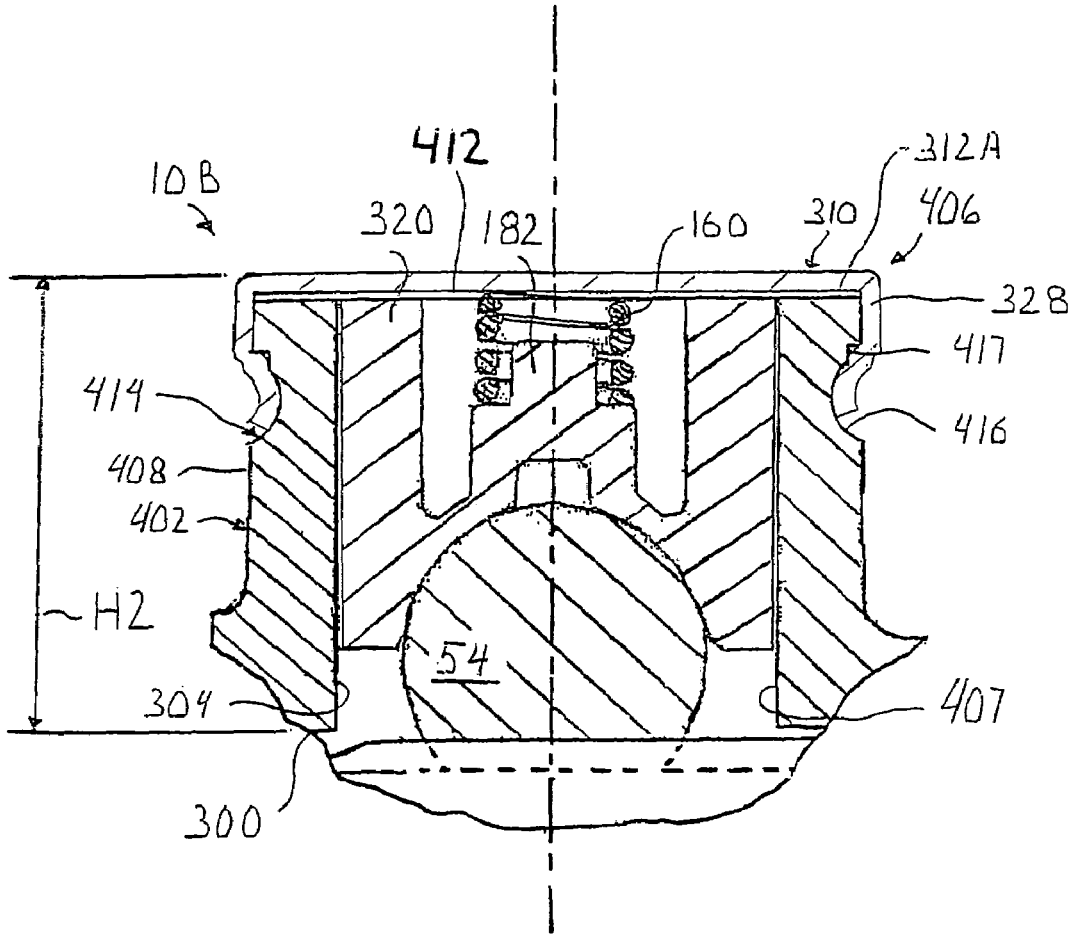
FIG. 5 is an enlarged sectional view of the portion of the rack and pinion steering gear illustrated in FIG. 4 showing the second embodiment of the yoke assembly in an assembled position.

Referring now to FIGS. 4 and 5, and using like reference numbers to indicate corresponding parts, there is illustrated a portion of a steering gear, illustrated generally at 10B, including a second embodiment of a yoke housing 402 and the yoke cap 310 according to the present invention. The yoke cap 310 is shown in a first or unassembled position in FIG. 4, and in a second or assembled position in FIG. 5.

The yoke housing 402 is substantially cylindrical in shape and includes an inner surface 407, an outer surface 408, and an opened end 412. The inner surface 407 of the yoke housing 402 defines the yoke bore 304. A recess 414 is formed in the outer surface 408 of the yoke housing 402. In the exemplary second embodiment illustrated in FIGS. 4 and 5, the recess 414 is a circumferential groove. Preferably, the groove 414 has a substantially arcuate surface portion 416 and a substantially rectangular portion or step portion 417 formed in an upper end (as viewed in FIGS. 4 and 5) of the surface portion 416.

As shown in this embodiment, the yoke assembly 406 is substantially identical to the yoke assembly 306 and is shown disposed in the yoke housing 402. The yoke assembly 406 includes the yoke bearing 320, the spring 160, and the yoke cap 310.

Figure 6:
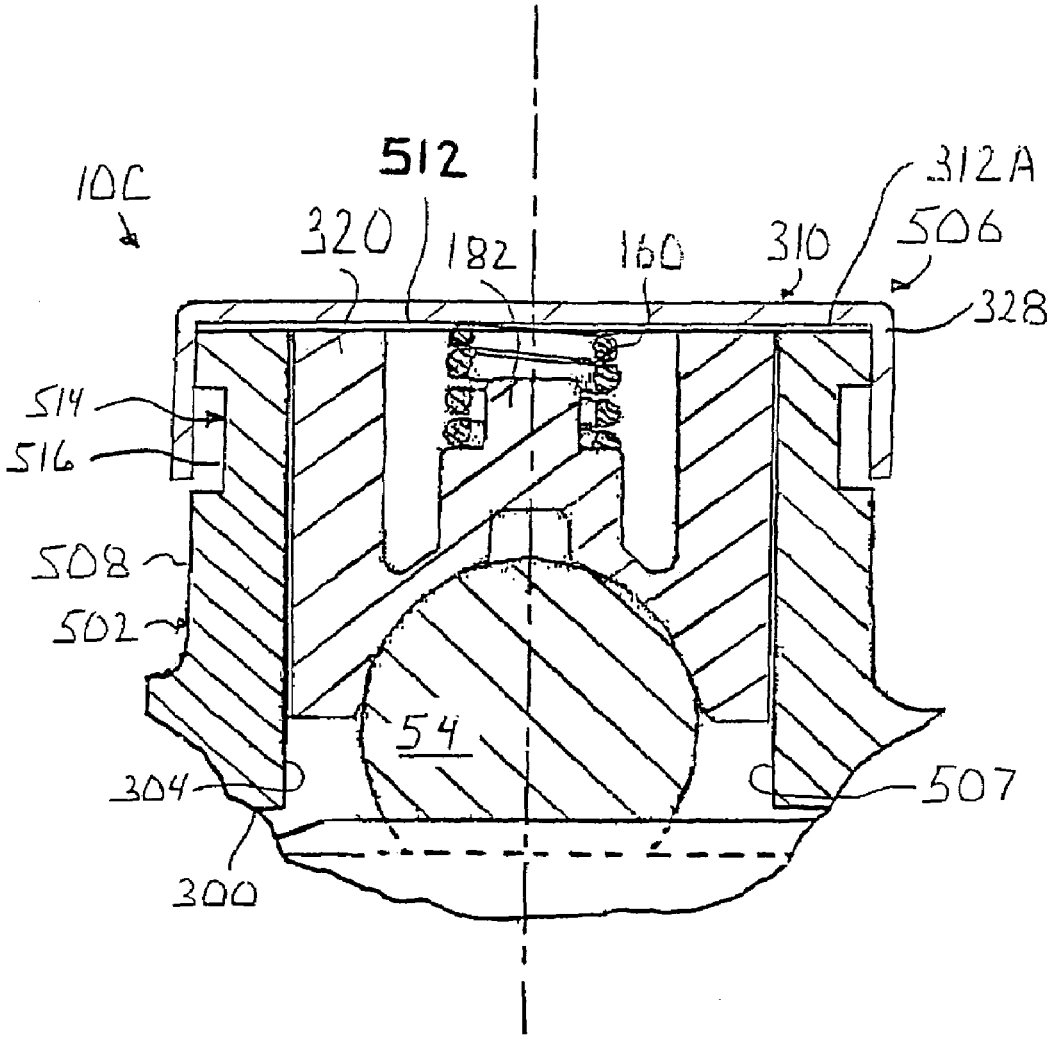
FIG. 6 is an enlarged sectional view of a portion of a rack and pinion steering gear including a third embodiment of a yoke assembly constructed in accordance with the present invention and shown in an unassembled position.
Figure 7:
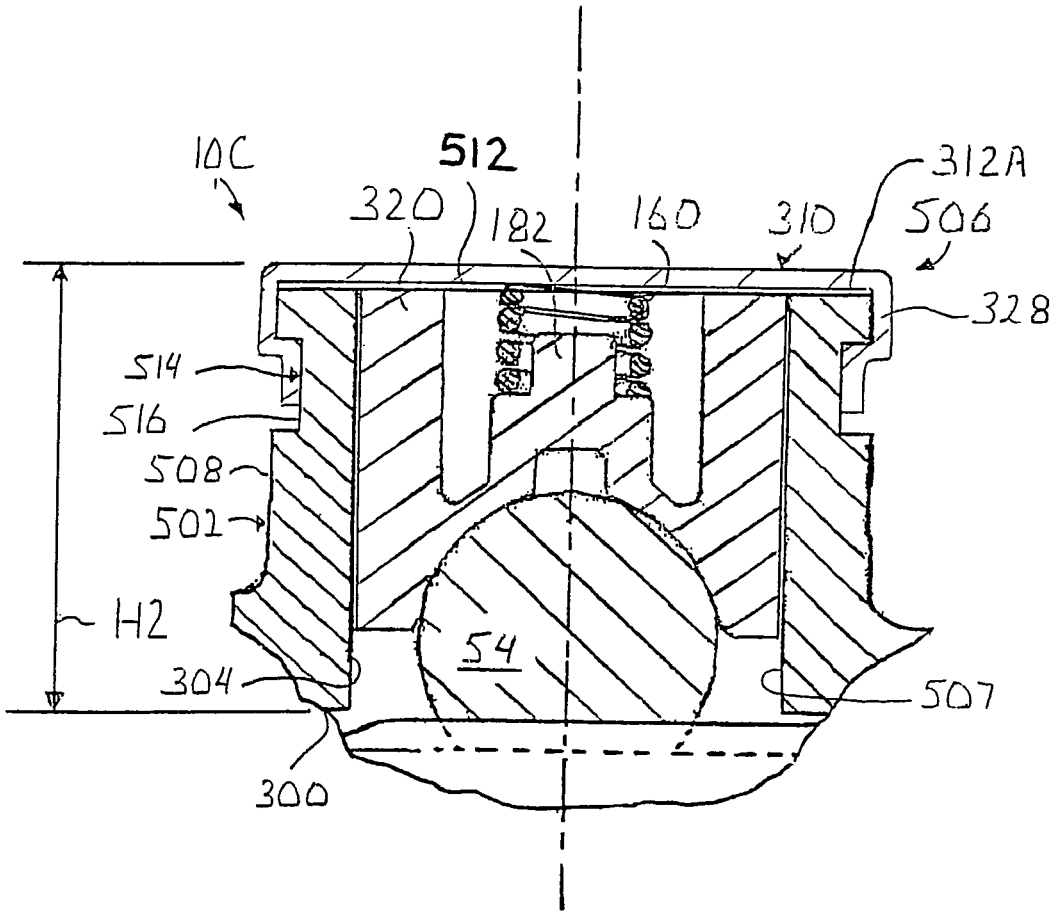
FIG. 7 is an enlarged sectional view of the portion of the rack and pinion steering gear illustrated in FIG. 6 showing the third embodiment of the yoke assembly in an assembled position.

Referring now to FIGS. 6 and 7, and using like reference numbers to indicate corresponding parts, there is illustrated a portion of a steering gear, illustrated generally at 10C, including a third embodiment of a yoke housing 502 and the yoke cap 310 according to the present invention. The yoke cap 310 is shown in a first or unassembled position in FIG. 6, and in a second or assembled position in FIG. 7.

The yoke housing 502 is substantially cylindrical in shape and includes an inner surface 507, an outer surface 508, and an opened end 512. The inner surface 507 of the yoke housing 502 defines the yoke bore 304. A recess 514 is formed in the outer surface 508 of the yoke housing 502. In the exemplary third embodiment illustrated in FIGS. 6 and 7, the recess 514 is a circumferential groove. Preferably, a cross section of a surface 516 of the groove 514 is substantially in the shape of three sides of a rectangle.

As shown in this embodiment, the yoke assembly 506 is substantially identical to the yoke assembly 306 and is shown disposed in the yoke housing 502. The yoke assembly 506 includes the yoke bearing 320, the spring 160, and the yoke cap 310.

Figure 8:
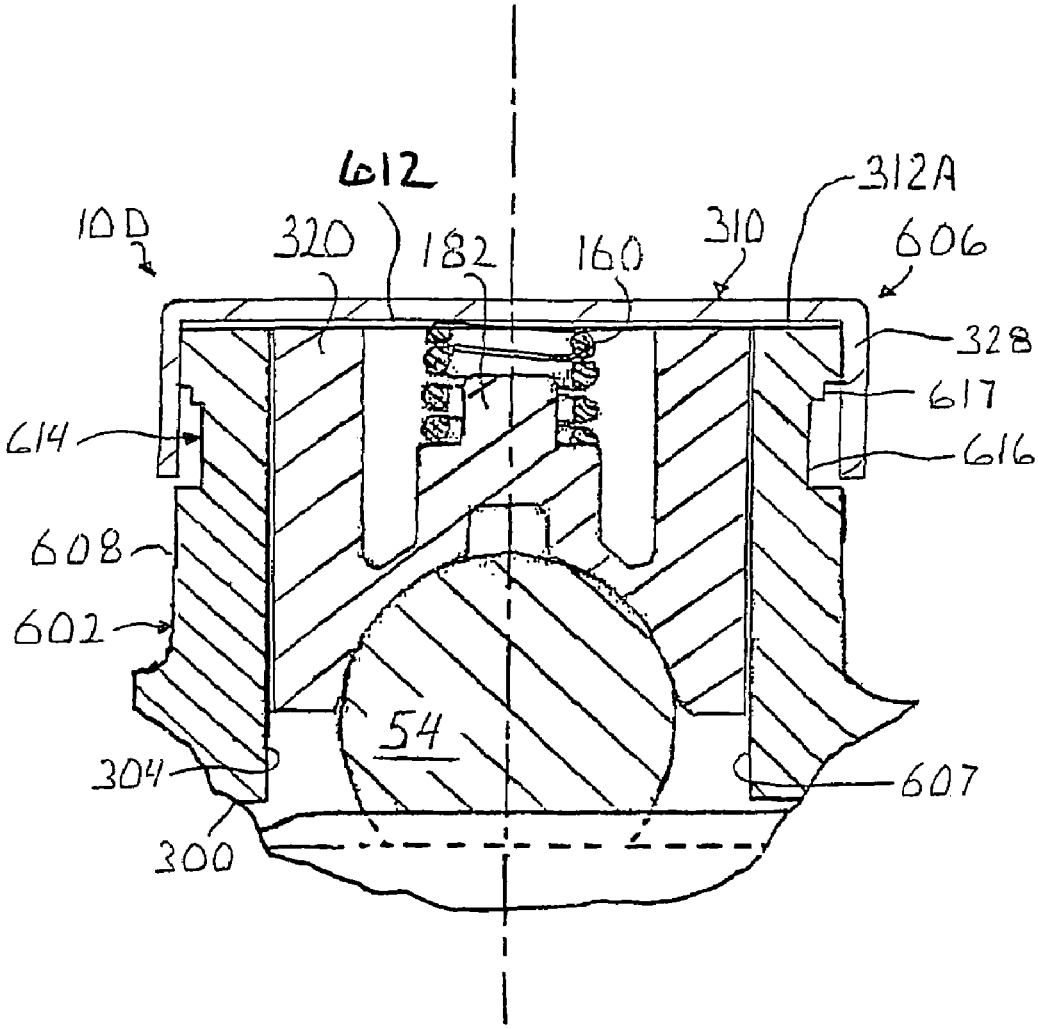
FIG. 8 is an enlarged sectional view of a portion of a rack and pinion steering gear including a fourth embodiment of a yoke assembly constructed in accordance with the present invention and shown in an unassembled position.
Figure 9:
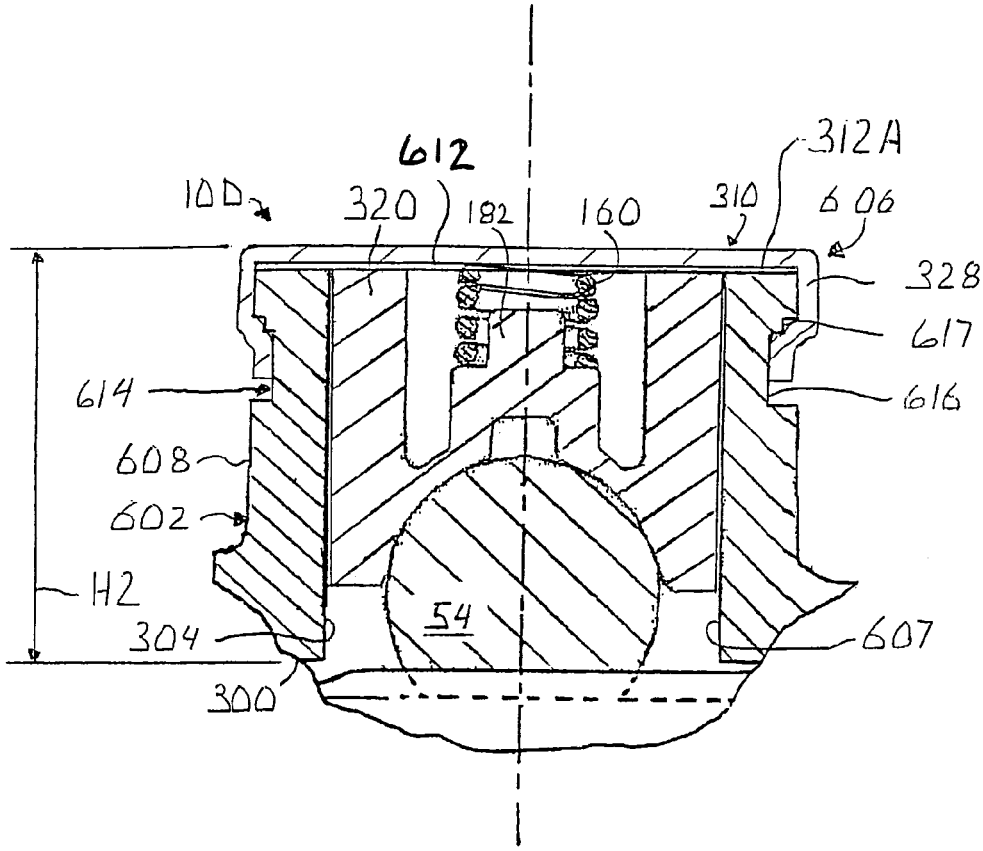
FIG. 9 is an enlarged sectional view of a portion of the rack and pinion steering gear illustrated in FIG. 8 showing the fourth embodiment of the yoke assembly in an assembled position.

Referring now to FIGS. 8 and 9, and using like reference numbers to indicate corresponding parts, there is illustrated a portion of a steering gear, illustrated generally at 10D, including a fourth embodiment of a yoke housing 602 and the yoke cap 310 according to the present invention. The yoke cap 310 is shown in a first or unassembled position in FIG. 8, and in a second or assembled position in FIG. 9.

The yoke housing 602 is substantially cylindrical in shape and includes an inner surface 607, an outer surface 608, and an opened end 612. The inner surface 607 of the yoke housing 602 defines the yoke bore 304. A recess 614 is formed in the outer surface 608 of the yoke housing 602. In the exemplary fourth embodiment illustrated in FIGS. 8 and 9, the recess 614 is a circumferential groove. A surface of the groove 614 includes a first or rectangular portion 616 and a second or step portion 617. Preferably a cross section of the first portion 616 is in the shape of three sides of a rectangle, and the step portion 617 extends radially outward from an upper end (as viewed in FIGS. 8 and 9) of the first portion 616.

As shown in this embodiment, the yoke assembly 606 is substantially identical to the yoke assembly 306 and is shown disposed in the yoke housing 602. The yoke assembly 606 includes the yoke bearing 320, the spring 160, and the yoke cap 310.

The recess formed in the outer surface (308, 408, 508, 608) has been described herein as a single circumferential groove (314, 414, 514, 614). However, it will be appreciated that, if desired, the outer surface (308, 408, 508, 608) can be other than as illustrated and include any suitable number of recesses having any suitable shape.

To assemble any of the illustrated embodiments of the yoke housing (302, 402, 502, 602) and the yoke cap 310 shown in FIGS. 2 through 9, inclusive, the yoke housing (302, 402, 502, 602) is preferably first formed by any desired method, such as by casting, machining, or a combination thereof, to include the circumferential groove (314, 414, 514, 614). The yoke bearing 320 and the spring 160 are then disposed within the yoke bore 304.

The yoke cap 310 is then disposed about the opened end 312 of the yoke housing (302, 402, 502, 602) and into the unassembled position, as shown in FIGS. 2, 4, 6, and 8, respectively. The side-wall 328 is then subjected to a deforming operation to cause a portion of the side-wall 328 to be deformed and reshaped to substantially conform to the shape of the recess (314, 414, 514, 614), thereby attaching the yoke cap 310 on the yoke housing (302, 402, 502, 602). Any desired deforming operation can be used, such as, for example roll-forming. It will be appreciated however, that any other desired deforming operation can also be used.

Preferably, a force is applied to at least at that portion of the side-wall 328 of the yoke cap 310 which is adjacent to the groove (314, 414, 514, 614) to deform the side-wall 328. The side-wall 328 is deformed such that the side-wall 328 conforms to the shape of the groove (314, 414, 514, 614) thereby forming a mechanical joint 329 and causing the yoke cap 310 to be permanently attached to the yoke housing (302, 402, 502, 602). The applied force thereby moves or deforms the side-wall 328 from the unassembled position shown in FIGS. 2, 4, 6, and 8, to the assembled position shown in FIGS. 3, 5, 7, and 9, respectively. Such a force can be applied by any desired method. Preferably, the side-wall 328 of the yoke cap 310 is moved to the assembled position by a force generated by an electromagnetic forming (EMF) process. More preferably, the side-wall 328 is moved to the assembled position by a MAGNEFORM® magnetic forming system manufactured by the Magneform Corporation of San Diego, Calif. If desired, an adhesive can be applied between the yoke cap 310 and the yoke housing (302, 402, 502, 602) so as to hold the yoke cap 310 in place prior to the EMF process.

In such a magnetic forming system, an electric current generates a pulsed magnetic field near a suitable metal surface, such as the side-wall 328 of the yoke cap 310, so as to create a controllable pressure which can reshape the yoke cap 310 without physical contact. Such pressure provides for an electrically conductive part to be joined to a part of any desired material, such as the yoke bearing 302, in a very small amount of time, such as within the range of from about 80 microseconds to about 100 microseconds.

In the exemplary embodiments illustrated in FIGS. 3, 5, 7, and 9, the side-wall 328 of the yoke cap 310 is shown engaging only a portion of the groove (314, 414, 514, 614). Alternatively, a yoke cap having a longer cap wall can be provided, such as shown at 310' in FIG. 10. For example, as shown in FIG. 10, an opened end 322' of the side-wall 328' extends beyond the groove 316 (below as viewed in FIG. 10) in the assembled position.

One advantage of the yoke housing (302, 402, 502, 602) and the cap 310 of the yoke assembly (306, 406, 506, 606) of the present invention is that the height H2 of the yoke housing (302, 402, 502, 602) with the cap 310 mounted thereon can be substantially smaller than the height of prior art yoke assemblies, such as the height H1 associated with the prior art yoke assembly 156 shown in prior art FIG. 1. A yoke housing (302, 402, 502, 602) and cap 310 having such a reduced height H2 requires less space in a vehicle than known yoke housings and yoke plugs.

A further advantage of the yoke housing (302, 402, 502, 602) and cap 310 of the yoke assembly (306, 406, 506, 606) of the present invention is that although the height H2 is smaller relative to the known height H1, the length L2 of the yoke bearing 320 can be increased relative to known yoke bearing lengths. As a result, the yoke assembly (306, 406, 506, 606) of the present invention can provide an increased contact area between yoke bearing 320 and the yoke bore 304 of the present invention while still not exceeding the known height H1.

Another advantage of the yoke housing (302, 402, 502, 602) and cap 310 of the yoke assembly (306, 406, 506, 606) of the present invention is that when the side-wall 328 of the yoke cap 310 is deformed so as to conform to the shape of the groove (314, 414, 514, 614), the yoke cap 310 is caused to be permanently attached to the yoke housing (302, 402, 502, 602) without threads, welding or adhesives.

Another advantage of the yoke housing (302, 402, 502, 602) and cap 310 of the yoke assembly (306, 406, 506, 606) of the present invention is that substantially the entire side wall 326 of the yoke bearing 320 is in contact with the yoke bore 304, also providing an increased contact area between yoke bearing 320 and the yoke bore 304. Because the entire yoke bearing 320 is in contact with the yoke bore 304, undesirable rattling of the yoke bearing 320 within the yoke bore 30 is reduced, thereby also significantly reducing undesirable noise, vibration and harshness (NVH). Because NVH is reduced, the need for an O-ring, such as the O-ring 198 illustrated in prior art FIG. 1, is thereby eliminated. However, it will be appreciated that an O-ring can be provided about the yoke bearing 320 if desired.

Yet another advantage of the yoke housing (302, 402, 502, 602) and cap 310 of the yoke assembly (306, 406, 506, 606) of the present invention is that he mechanical joint 329 is sufficiently water-tight such that a second O-Ring, such as the O-ring 200 can be eliminated.

Another advantage of the yoke housing (302, 402, 502, 602) and cap 310 of the yoke assembly (306, 406, 506, 606) of the present invention is that the short duration forming time (about 80 microseconds to about 100 microseconds) reduces production time and man-hours, thereby reducing cost.

Another advantage of the yoke housing (302, 402, 502, 602) and cap 310 of the yoke assembly (306, 406, 506, 606) of the present invention is that because there is no physical contact between the MAGNEFORM® magnetic forming system and the yoke housing (302, 402, 502, 602), manufacturing process time is reduced relative to manufacturing process times for known yoke housings and yoke plugs.

In accordance with the provisions of the patent statues, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A method for producing a yoke assembly adapted for use in a rack and pinion steering gear assembly for a vehicle, the method comprising the steps of:

(a) providing a yoke cap having a side-wall;

(b) providing a yoke housing having a wall defining a yoke chamber and an opened end, the wall provided with a recess formed therein;

(c) disposing the yoke cap about the opened end of the yoke housing such that the yoke cap extends adjacent at least a portion of the recess; and (d) subjecting the side-wall of the yoke cap to a metal deforming operation to cause a portion of the side-wall of the yoke cap to be deformed and reshaped to substantially conform to the shape of the recess thereby attaching the yoke cap on the yoke housing.

2. The method according to claim 1, wherein the yoke cap is substantially cup shaped.

3. The method according to claim 1, wherein the yoke cap in step (a) is formed from an electrically conductive material and step (d) includes applying a pulsed magnetic field from a source of electromagnetic energy to the yoke cap so as to deform and reshape the portion of the side-wall to substantially conform to the shape of the recess.

4. The method according to claim 1, wherein the recess is a circumferential groove.

5. The method according to claim 4, wherein the groove has a substantially arcuate shape.

6. The method according to claim 5, wherein the groove further includes a step.

7. The method according to claim 4, wherein the groove further includes a step.

8. The method according to claim 4, wherein the yoke cap is formed of an electrically conductive material.

* * * * *